US011910842B1

(12) United States Patent
Adams

(10) Patent No.: US 11,910,842 B1
(45) Date of Patent: Feb. 27, 2024

(54) MEN'S UNDERWEAR

(71) Applicant: William C. Adams, Roberta, GA (US)

(72) Inventor: William C. Adams, Roberta, GA (US)

( * ) Notice: Subject to any disclaimer, the term of this patent is extended or adjusted under 35 U.S.C. 154(b) by 0 days.

(21) Appl. No.: 17/676,421

(22) Filed: Feb. 21, 2022

(51) Int. Cl.
*A41B 9/00* (2006.01)
*A41B 9/02* (2006.01)

(52) U.S. Cl.
CPC ..... *A41B 9/026* (2013.01)

(58) Field of Classification Search
CPC .. A41B 9/026; A41B 9/00; A41B 9/02; A41B 9/025; A41B 9/004
See application file for complete search history.

(56) References Cited

U.S. PATENT DOCUMENTS 2,058,970 A * 10/1936 Fiesh ..... A41D 7/005 2/403
3,207,155 A * 9/1965 Casey ..... A41B 9/026 2/403
3,621,846 A * 11/1971 Lehman ..... A61F 5/40 2/403
3,968,803 A * 7/1976 Hyman ..... A61F 13/145 602/61
4,345,337 A * 8/1982 Chung ..... A41B 9/023 2/405
4,377,008 A * 3/1983 Jung ..... A41B 9/023 2/403
4,526,167 A * 7/1985 Ebenal ..... A41B 9/023 2/403
4,660,551 A * 4/1987 Nishimura ..... A41B 9/023 2/405
4,917,651 A * 4/1990 Rainville ..... A41C 3/02 2/101
5,032,104 A * 7/1991 Rainville ..... A41C 3/02 2/101
5,283,912 A * 2/1994 Chung ..... A41B 9/023 2/403
5,484,395 A * 1/1996 DeRoche ..... A61F 5/028 2/311
5,524,298 A * 6/1996 Plunkett ..... A41B 9/023 2/403
5,647,065 A * 7/1997 Richerson ..... A41B 9/023 2/403
5,718,003 A * 2/1998 Gwinn ..... A41B 9/023 2/403
5,870,779 A * 2/1999 Heron ..... A41B 9/023 2/403
5,875,495 A * 3/1999 Thrower ..... A41B 9/023 2/403
6,038,703 A * 3/2000 Chung ..... A61F 5/40 2/403
6,280,287 B1 * 8/2001 Keith ..... A41F 1/006 450/41
6,820,284 B2 * 11/2004 Horikoshi ..... A41B 9/023 2/403
7,178,174 B2 * 2/2007 Soderstrom ..... A41B 9/02 2/403
7,676,853 B1 * 3/2010 Cutlip ..... A41B 9/023 2/403

(Continued)

*Primary Examiner* — Richale L Quinn
(74) *Attorney, Agent, or Firm* — Walter A. Rodgers

(57) ABSTRACT

Men's underwear having an opening in the front with a pair of overlapping panels overlying the opening with a tactile element secured to one or both panels.

1 Claim, 5 Drawing Sheets

(56) References Cited

U.S. PATENT DOCUMENTS 7,788,739 B1 * 9/2010 Della Ratta ..... A41B 9/023 2/403
7,958,571 B2 * 6/2011 Kitsch ..... A41B 9/023 2/403
8,555,422 B2 * 10/2013 Steele ..... A41B 9/023 2/403
8,782,817 B2 * 7/2014 Gu ..... A41B 9/002 2/405
9,456,641 B1 * 10/2016 Mignone ..... A41D 31/185
D809,243 S * 2/2018 Kimel ..... D2/712
10,342,266 B2 * 7/2019 Oh ..... A41B 9/023
10,638,797 B2 * 5/2020 Ellingson ..... A41B 9/023
D894,530 S * 9/2020 Perry ..... D2/712
10,849,367 B2 * 12/2020 Brown, Sr. ..... A61F 13/15
10,849,382 B2 * 12/2020 Weispfennig ..... A41F 15/002
11,272,744 B2 * 3/2022 Shaughnessy ..... A41B 9/004
11,412,785 B2 * 8/2022 Washington ..... A41B 9/023
2004/0049835 A1 * 3/2004 Horikoshi ..... A41B 9/023 2/400
2006/0162052 A1 * 7/2006 Stankowski ..... A41B 9/02 2/403
2007/0220661 A1 * 9/2007 Blohmann ..... A41B 9/023 2/404
2008/0178369 A1 * 7/2008 Kitsch ..... A41B 9/023 2/405
2009/0320184 A1 * 12/2009 Schaefer ..... A41B 9/02 2/400
2011/0113532 A1 * 5/2011 Harout ..... A41B 9/02 2/403
2012/0260404 A1 * 10/2012 Steele ..... A41B 9/026 2/403
2013/0239300 A1 * 9/2013 Denning ..... A41D 27/00 2/400
2014/0143935 A1 * 5/2014 Rose ..... A41F 1/002 2/234
2015/0074874 A1 * 3/2015 Ferber ..... A41D 1/06 2/400
2016/0066622 A1 * 3/2016 Howard ..... A41B 9/026 2/405
2017/0135875 A1 * 5/2017 Johnson ..... A61F 13/4906
2017/0238618 A1 * 8/2017 Blibech ..... A41B 9/14
2019/0090552 A1 * 3/2019 Crump ..... A41B 9/023
2019/0110523 A1 * 4/2019 Gu ..... A41B 9/023
2019/0110527 A1 * 4/2019 Ghasletwala ..... A41F 1/002
2019/0125001 A1 * 5/2019 Killian ..... A41B 9/026
2019/0274374 A1 * 9/2019 Marconi ..... A41B 9/026
2019/0307178 A1 * 10/2019 Polynski ..... A41B 9/026
2019/0343195 A1 * 11/2019 Stewart ..... A41D 1/088
2020/0060353 A1 * 2/2020 Crump ..... A41B 9/023
2021/0259326 A1 * 8/2021 Shaughnessy ..... A41B 9/001
2021/0337883 A1 * 11/2021 Patmore ..... A41B 9/026
2021/0360982 A1 * 11/2021 Princic ..... A41B 9/001
2021/0392977 A1 * 12/2021 Stigger ..... A41D 31/305
2022/0007749 A1 * 1/2022 Brown ..... A41D 13/02
2022/0039483 A1 * 2/2022 Agou ..... A41B 9/02
2022/0061405 A1 * 3/2022 Lee ..... A41B 9/004
2022/0133527 A1 * 5/2022 Brown ..... A41B 9/005 128/844
2022/0192293 A1 * 6/2022 Bell ..... A41D 13/1263
2022/0279861 A1 * 9/2022 Massey ..... A41B 9/02
2022/0386710 A1 * 12/2022 Hierholzer ..... A41B 9/023

* cited by examiner

MEN'S UNDERWEAR

The benefits under 35 USC 119(e) are claimed of provisional patent applications 63/152,991 filed Feb. 24, 2021 and 63/254,279 filed Oct. 11, 2021.

BACKGROUND OF THE INVENTION

Men's underwear, whether boxers or briefs, generally comprises a front and back with a front opening formed in the front by a pair of overlapping fabric panels or a single panel overlying the opening. Typically, in use, it is difficult to locate the underwear opening since the two panels that form the opening lie in an overlapping face contacting relation or, in some versions, a single panel covers the opening. The panels lie close to the body and do not embody a convenient tactile ability to locate the opening.

BRIEF SUMMARY OF THE INVENTION

Men's underwear, according to this invention, includes underwear of various styles all of which generally include a waistband, a front and a back sewn along the side edges with leg openings opposite the waistband. An opening is formed in the front with at least one panel or a pair of overlapping panels secured to the front and overlying the opening with a tactile element secured to at least one of the panels.

DETAILED DESCRIPTION OF THE INVENTION

Figure 1:
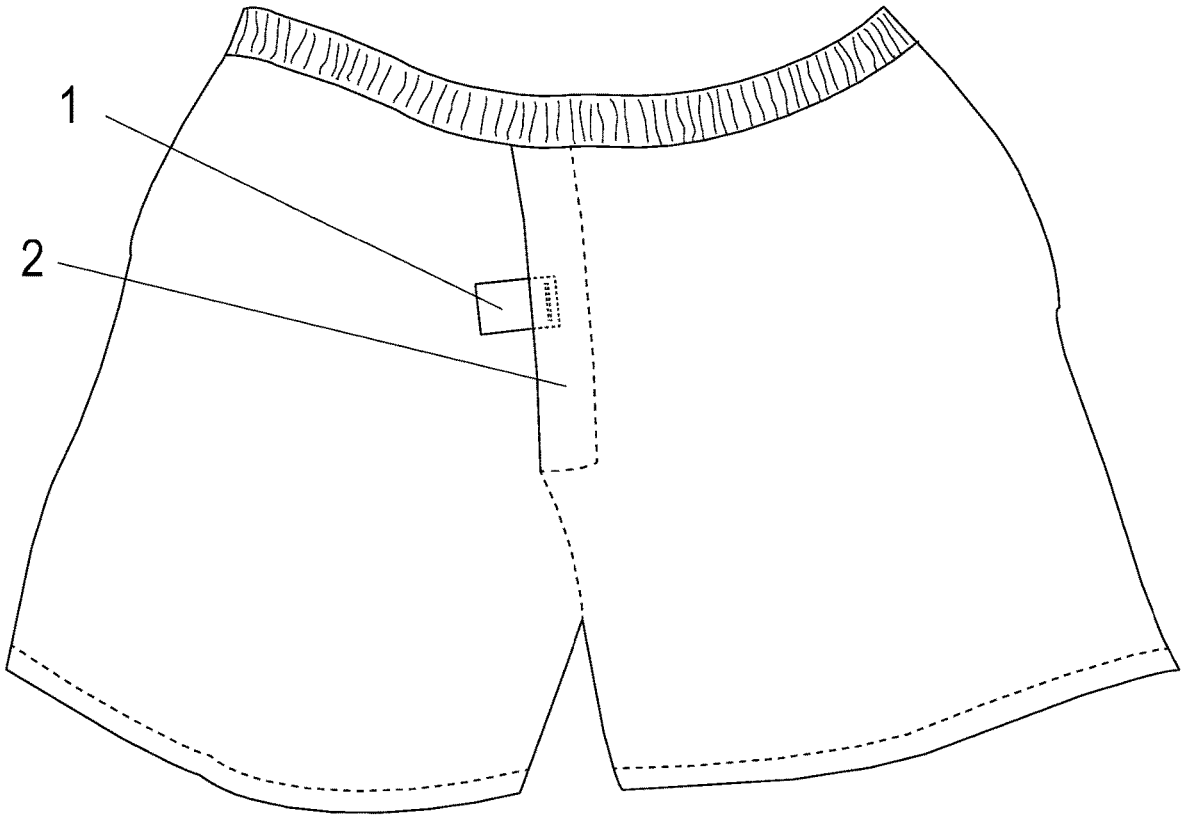
FIGS. 1-5 are elevational views of a pair of men's underwear illustrating the various embodiments of the underwear, according to this invention.

Men's underwear embodies a variety of types and styles including boxers, briefs, and long and short underwear. Although the drawing figures and accompanying description are directed to conventional boxer-type underwear as the preferred embodiment of the invention, the invention is equally adaptable to the various known types of men's underwear and not limited to a particular model or configuration.

As shown in the drawings, the underwear includes a conventional elastic waistband A attached to the top of front panel B and a pair of leg openings C and D at the bottom with an opening generally formed in the front by a pair of overlapping flaps or panels.

According to this invention, means is provided to quickly locate and manipulate the opening of men's underwear, in one embodiment, in the form of a tab identified by the numeral 1 in FIG. 1. Tab 1 is affixed to the overlapping outer panel 2 of the underwear by any suitable means such as glue, staples, sewing and the like. Tab 1 can be similarly affixed to the underlying inner panel or to the underside of outer panel 2. Additionally, a pair of tabs 1 can be made of conventional hook and loop fastener material with the respective tabs affixed to both the outer and inner panels. The panels can be secured together and thereby close the opening, if so desired.

Figure 2:
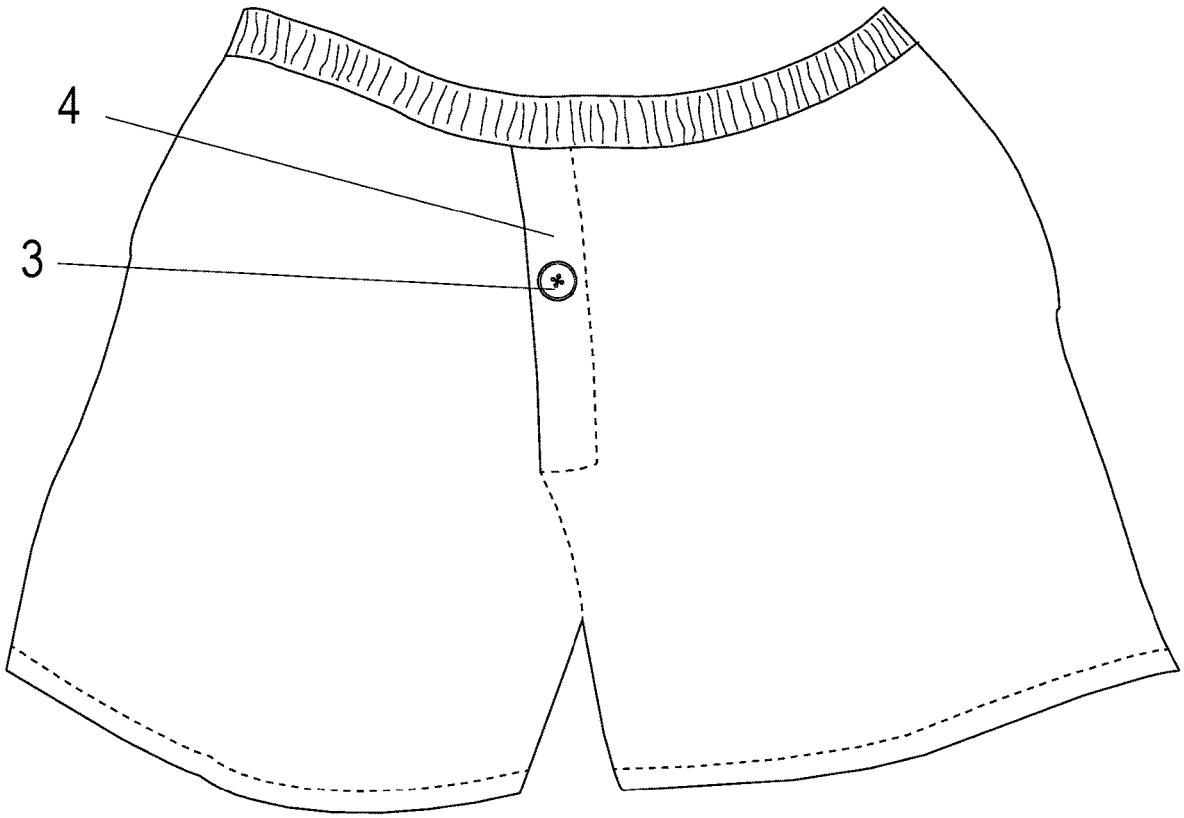

An alternative embodiment of the invention is shown in FIG. 2 in which button 3 is sewn to outer panel 4. Button 3 can also be sewn onto the underlying inner panel or to the underside of outer panel 4 and will achieve the same result and advantages of tab 1, shown in FIG. 1.

Figure 3:
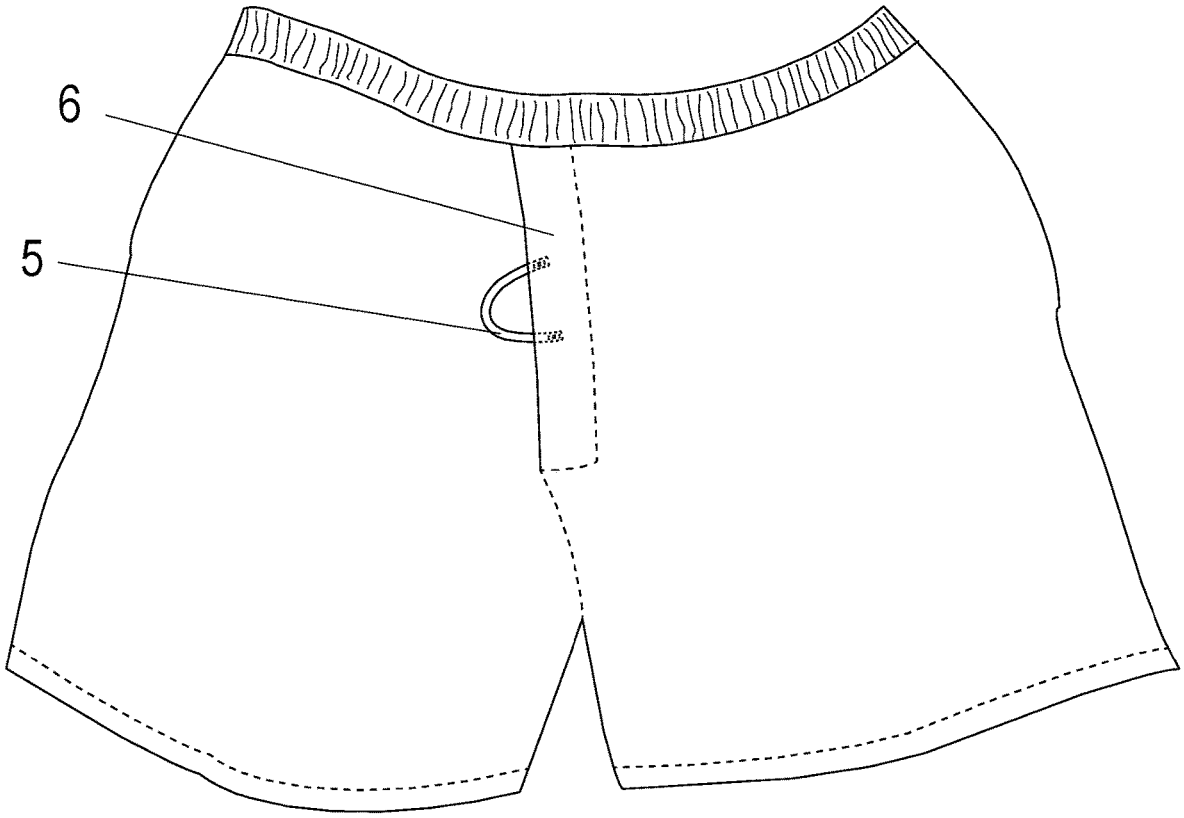
Figure 4:
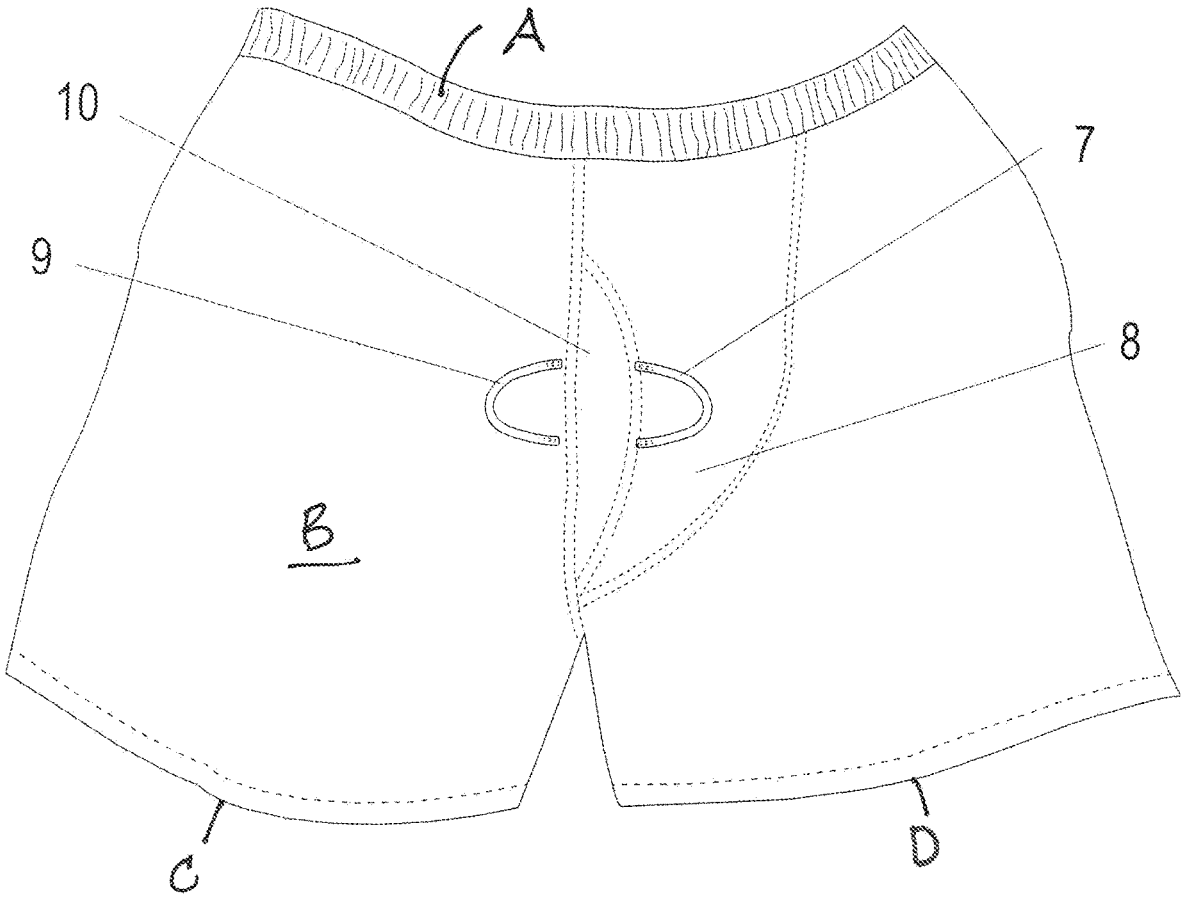
Figure 5:
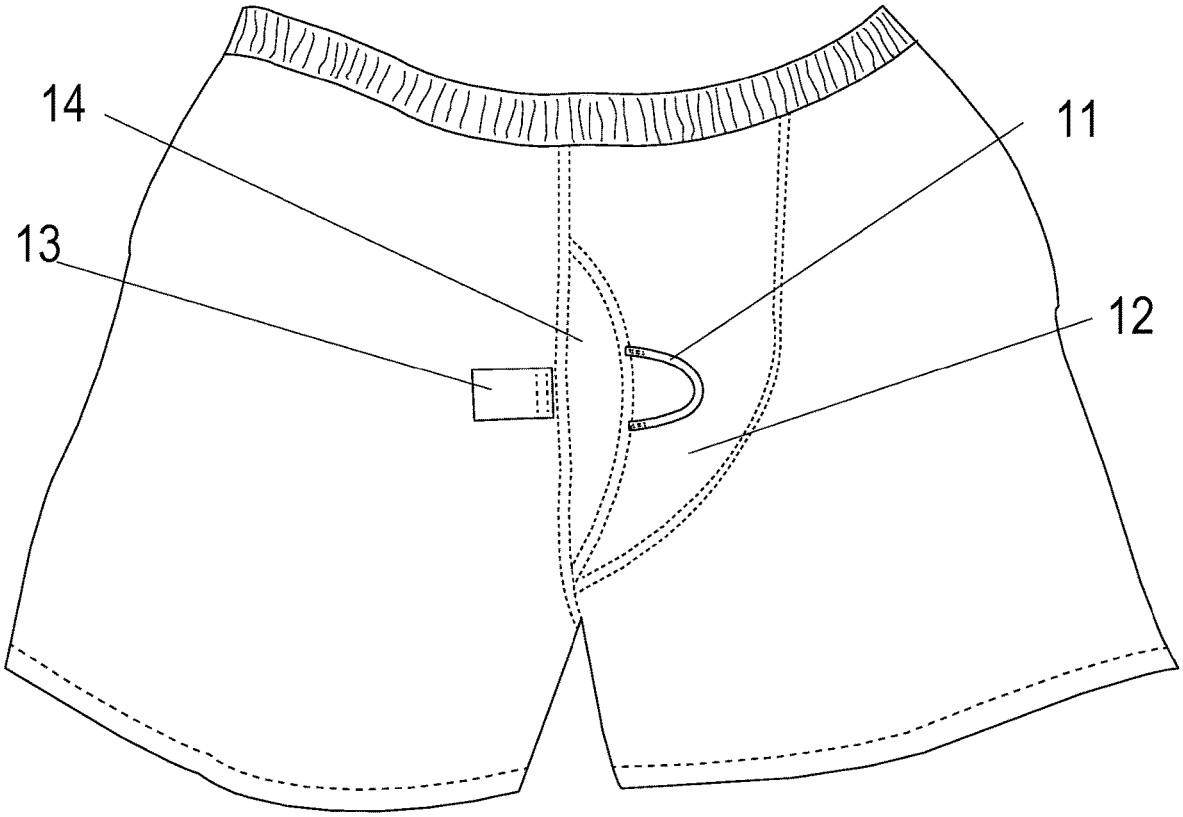

Further embodiments of the invention are shown in FIGS. 3-5 wherein, in FIG. 3, flexible loop 5 is secured to the inner surface of outer panel 6. Alternatively, as shown in FIG. 4, flexible loop 7 is attached to the exterior surface of outer panel 8. A second flexible loop 9 is affixed adjacent to the underwear stationary inner panel 10 opposite loop 7 or directly to the inner panel depending on the particular style of underwear so as to be adaptable for manipulation either from the right or left side of the underwear. Loops 7 and 9 are disposed directly opposite each other and extend outwardly in diametrically opposite directions. Another embodiment is shown in FIG. 5 wherein flexible loop 11 is affixed to outer panel 12 with tab 13 secured to the underwear adjacent inner panel opposite flexible loop 11.

As shown in the men's underwear applications in FIGS. 1-5, a myriad of combinations of a button, tab and loop are attachable to the exterior of the outer panel or underside of the outer panel of a pair of underwear. Also, any of the attachment means can be affixed to the underwear at the opposite side of the opening from the outer panel or directly to the inner panel, depending on the style of underwear.

In actual practice, this invention is applicable to affixing both single and double configurations of buttons, tabs and loops to the opening to accommodate the various desired applications.

In addition, the invention is adaptable to providing an opening in the rear of the underwear with the tab, button or loop feature in accordance with this invention to accommodate the particular desires and needs of the user.

Aside from a functional application and for purposes of a novelty application, this invention is adaptable to women's underwear as a gag or joke gift.

Therefore, by this invention, a convenient means is provided whereby an individual can quickly identify the opening in men's underwear and then utilize the tab, button or loop feature or a combination thereof to easily open and close the opening.

The invention claimed is:

1. Men's underwear comprising a waistband, a front panel extending downwardly from said waistband, a pair of leg openings opposite said waistband, an opening formed in said front panel, one panel joined to said front panel and overlapping said opening, a tactile element secured to said one panel comprising a first flexible loop secured to said one panel, said first flexible loop adapted for manual manipulation, a second panel joined to said front panel and underlying said first panel, a second tactile element secured to said second panel comprising a second flexible loop adapted for manual manipulation, and said first flexible loop disposed directly across from said second flexible loop and said flexible loops extending outwardly in diametrically opposite directions.

* * * * *